US005090572A

United States Patent [19]

DeRoseau

[11] Patent Number: 5,090,572

[45] Date of Patent: Feb. 25, 1992

[54] COMBINATION FOOD CONTAINER AND EATING UTENSIL

[76] Inventor: Robert F. DeRoseau, 4296 Lake Knolls, Oxford, Mich. 48051

[21] Appl. No.: 733,370

[22] Filed: Jul. 22, 1991

Related U.S. Application Data

[60] Continuation of Ser. No. 493,982, Mar. 15, 1990, abandoned, which is a division of Ser. No. 232,802, Aug. 16, 1988, Pat. No. 4,930,637.

[51] Int. Cl.[5] ..... A45C 11/20

[52] U.S. Cl. ..... 206/542; 206/541; 229/1.5 C

[58] Field of Search ..... 206/234, 541, 542; 229/1.5 C, 103.1; 220/90.2, 85 D; 215/DIG. 5

[56] References Cited

U.S. PATENT DOCUMENTS

| | | | |
|---|---|---|---|
| 1,514,379 | 11/1924 | Fleischer . | |
| 1,516,334 | 11/1924 | Clement | 229/1.5 C |
| 1,607,865 | 11/1926 | Butler | 215/DIG. 5 |
| 1,625,335 | 4/1927 | Schneider . | |
| 1,889,111 | 11/1932 | Serr | 229/1.5 C |
| 2,034,067 | 3/1936 | Stone | 229/1.5 C |
| 2,353,582 | 7/1944 | Pearson . | |
| 2,433,926 | 1/1948 | Sayre | 229/1.5 C |
| 2,604,976 | 7/1952 | Sarg | 206/541 |
| 3,015,429 | 1/1962 | Morici | 206/459 |
| 3,679,093 | 7/1972 | Chang . | |
| 3,870,220 | 3/1975 | Koury et al. | 229/1.5 C |
| 4,036,398 | 7/1977 | Hoogvelt et al. | 220/85 D |
| 4,216,875 | 8/1980 | Stanish | 229/1.5 C |
| 4,789,064 | 12/1988 | Segal | 220/85 D |

FOREIGN PATENT DOCUMENTS

| | | | |
|---|---|---|---|
| 381606 | 10/1964 | Switzerland | 220/85 D |
| 1010450 | 11/1965 | United Kingdom | 220/85 D |
| 1349332 | 4/1974 | United Kingdom | 229/1.5 C |

*Primary Examiner*—David T. Fidei
*Attorney, Agent, or Firm*—Alex Rhodes

[57] ABSTRACT

A combination food container and eating utensil for the storing and partaking of prepared food. The container has a body which is adapted for preserving food and a removable cover attached to an outward extending flange on the upper portion of the body. The body has a bottom wall and an outer wall extending upwardly from the periphery of the bottom wall. Inside of the container there is at least one utensil, such as a knife, fork or spoon, stored in a pocket formed by the cover, the side wall and a liner spaced below the cover which partitions the interior of the body into an upper pocket for storing the utensil and a lower pocket for storing food. The utensil in the interior of the container is removably attached to the lower surface of the cover and is accessible to a user when the cover is detached from the body.

3 Claims, 1 Drawing Sheet

COMBINATION FOOD CONTAINER AND EATING UTENSIL

This is a continuation of copending application Ser. No. 07/493,982 filed on Mar. 15, 1990, now abandoned, which is a divisional of prior application Ser. No. 07/232,802 filed on Aug. 16, 1988, now Pat. No. 4,930,637.

BACKGROUND OF THE INVENTION

This invention relates to food containers and more particularly to disposable food containers for preserving food, by way of example, frozen dinners and restaurant carryouts, which include eating utensils. One aspect of the current practice is that containers for prepared foods do not include knives, spoons or forks for partaking of the foods. The objection to this practice is that the utensils are often inadvertently omitted or not available at the sources of the foods.

Another aspect of the current practice is that the food utensils which are supplied with prepared foods are generally supplied without outer wrappings. The objection to this practice is that unwrapped utensils pose a health risk.

Despite the benefits of providing eating utensils in food containers, none of the combination food container and utensil concepts of the prior art have achieved commercial success. It is believed that the reasons they have not achieved success is the added cost and/or functional deficiencies.

Fleischer U.S. Pat. No. 1,514,379, Schneider U.S. Pat. No. 1,625,335, Pearson U.S. Pat. No. 2,353,582 and Chang U.S. Pat. No. 3,679,093 are exemplary of food containers having utensils in the prior art.

Fleischer U.S. Pat. No. 1,514,379, more than sixty years ago, patented a construction for an ice cream cup with a cover containing a spoon. The cover was comprised of a bottom member and a top sheet of waterproof paper bonded to an outwardly-extending flange portion of the bottom member.

Shortly after Fleischer patented his ice cream cup, Schneider U.S. Pat. No. 1,625,335 patented an ice cream cup having a paper cover with an exposed utensil portion which was separable from the cover along a tear line.

Pearson U.S. Pat. No. 2,353,582 patented an ice cream cup having a cover formed of a plurality of layers and a partially exposed spoon stored between the layers of the cover.

Chang U.S. Pat. No. 3,679,093 patented a food container having a utensil enclosed in a compartmented cover which was accessible by severing a portion of the outer covering along a perforated line.

In view of the objections to the current practice and the variety of concepts for a combination food and utensil container which have long been available in the prior art, it will be appreciated that a long felt need exists which, as yet, remains unsatisfied.

SUMMARY OF THE INVENTION

The present invention is a disposable combination food container and eating utensil. It is contemplated that the invention will be used by the general public for purposes such as, picnics and student and worker box lunches as well as for commercially prepared foods, such as, frozen foods and restaurant carryouts.

The invention comprises a body which is adapted for preserving food, at least one utensil stored in a pocket of the container for partaking of the food inside of the container, and a novel means for positioning the utensil in the pocket of the container. A significant benefit of the invention is that utensils are provided inside of a container at a lower cost than heretofore possible.

The body has a bottom wall, a cylindrical side wall extending upwardly from the periphery of the bottom wall and a horizontal circular flange extending outwardly from the upper edge of the side wall. Inside of the container there is a circular liner which partitions the container into an upper pocket for storing the utensil and a lower pocket for storing food. The utensil is joined to the lower surface of the cover and is accessible to a user when the cover is removed.

The foregoing objects, features, and benefits along with other objects, features and benefits as well as the manner of practicing the invention in accordance with the best mode contemplated will be understood from the ensuing description and accompanying drawings which described the invention in detail.

DETAILED DESCRIPTION OF THE PREFERRED EMBODIMENT

Figure 1:
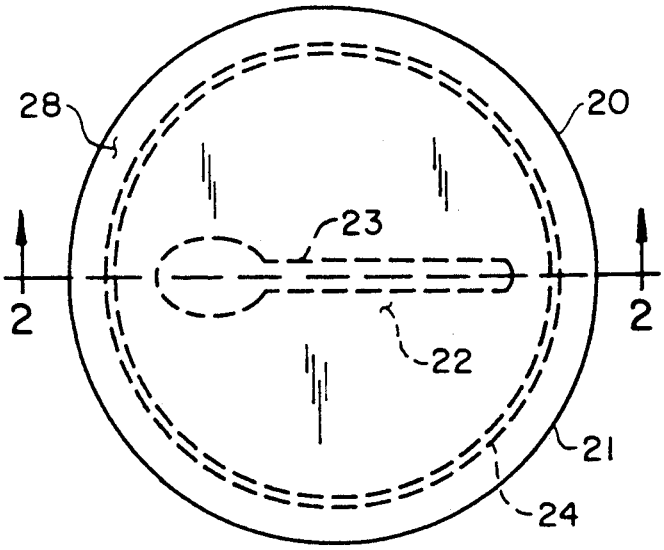
FIG. 1 is a plan view of a cylindrical container having a utensil stored in a pocket of a container formed by a depression in a cover and a strip of adhesive tape.
Figure 2:
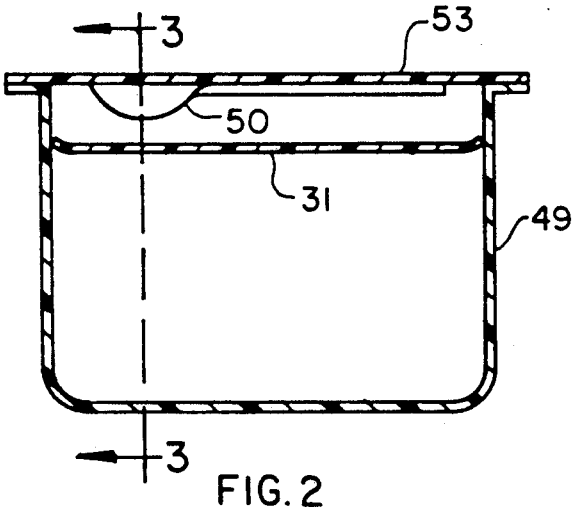
FIG. 2 is a vertical section taken on the line 2—2 of FIG. 1.
Figure 3:
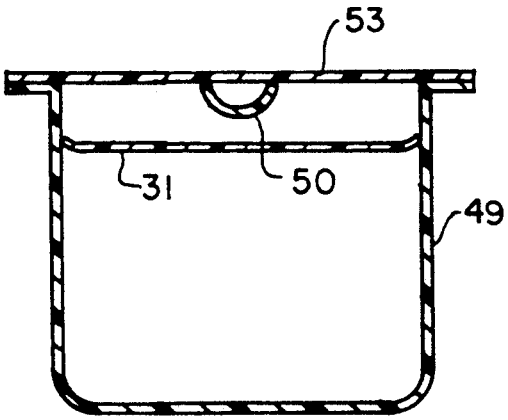
FIG. 3 is a vertical section taken on the line 3—3 of FIG. 2.

Referring now to the drawings wherein like numerals designate like and corresponding parts throughout the several views, the present invention of a combination food and utensil container 20 comprises a body 21 having a sealed pocket 22 for storing an eating utensil 23 and at least one eating utensil 23 protectively stored in the pocket 22 of the container 20. An important benefit of the invention is that utensils are provided in a sealed pocket of a container at a lower cost than heretofore possible.

The body 21 has a bottom wall 25, a cylindrical side wall 26 extending upwardly from the periphery of the bottom wall 25 and a horizontal circular flange 27 extending outwardly from the upper edge of the side wall 26. A cover 28 is bonded to the outward extending flange 27. Inside of the container 20 there is a circular liner 31 which is spaced away from the cover 28 onto the food (not shown) below the liner 31.

The liner 31 partitions the container 20 into an upper pocket 22 for storing the utensil 23 and a lower pocket for food. The utensil 23 and the cover 28 are perferably made of a plastic material. The utensil 23 is joined to the lower surface of the cover 28 by sonic welding or some other suitable means.

It will be appreciated that my invention is not limited to cylindrical containers and is adaptable to other containers such as rectangular and pie shaped containers.

From the foregoing detailed description it will be appreciated that my invention provides a combination food and utensil container free of contamination which is lower in cost than heretofore possible.

Although but a single embodiment of my invention has been described, it will be appreciated that other embodiments can be provided by changes in size, shape, materials and arrangement of parts without departing from the spirit hereof.

I claim:

1. In a food container for the storing and the partaking of food in a sanitary manner of the type having a one-piece cover attached to the body of the container, the improvement which comprises a partitioned body having a pocket in said container for storing at least one eating utensil, said body having a bottom wall, an upward-extending peripheral wall joined to said bottom wall; a flat outer cover attached to the upper end portion of said peripheral wall; a substantially flat liner spaced below said upper end portion of said body for partitioning the container into an upper pocket for storing a utensil and a lower pocket for storing food; and at least one eating utensil having an elongated portion stored in said pocket, said elongated portion of said utensil being welded directly to the lower surface of said cover.

2. The combination food container and utensil recited in claim 1 wherein said body is a cylindrical shaped body comprising a circular lower wall and an upward-extending peripheral cylindrical wall.

3. The combination food container and utensil recited in claim 1 wherein said body is a rectangular shaped body comprising a rectangular lower wall and an upward-extending peripheral rectangular wall.

* * * * *